US010857437B2

(12) United States Patent
Lalaoua

(10) Patent No.: US 10,857,437 B2
(45) Date of Patent: Dec. 8, 2020

(54) SHOCK-ABSORBING LIGHT-AND-SIREN, HOLOGRAM PROJECTION ADVERTISEMENT, AND SENSING GOAL POST SYSTEM

(71) Applicant: Nabile Lalaoua, Las Vegas, NV (US)

(72) Inventor: Nabile Lalaoua, Las Vegas, NV (US)

( * ) Notice: Subject to any disclaimer, the term of this patent is extended or adjusted under 35 U.S.C. 154(b) by 0 days.

(21) Appl. No.: 15/861,327

(22) Filed: Jan. 3, 2018

(65) Prior Publication Data

US 2018/0185724 A1 Jul. 5, 2018

Related U.S. Application Data

(60) Provisional application No. 62/498,586, filed on Jan. 3, 2017.

(51) Int. Cl.
*A63B 63/00* (2006.01)
*A63B 71/06* (2006.01)
(Continued)

(52) U.S. Cl.
CPC ..... *A63B 63/004* (2013.01); *A63B 43/004* (2013.01); *A63B 71/0054* (2013.01); *A63B 71/023* (2013.01); *A63B 71/0605* (2013.01); *A63B 71/0622* (2013.01); *A63B 71/0669* (2013.01); *A63B 2024/0037* (2013.01); *A63B 2063/005* (2013.01); *A63B 2071/0063* (2013.01); *A63B 2071/0625* (2013.01);
(Continued)

(58) Field of Classification Search
CPC . A63B 63/004; A63B 71/023; A63B 71/0622; A63B 2071/0063; A63B 2220/806; A63B 2220/833
USPC ..... 473/478
See application file for complete search history.

(56) References Cited

U.S. PATENT DOCUMENTS 4,703,931 A * 11/1987 Steen ..... A63B 69/0097 273/410
5,080,375 A * 1/1992 Moosavi ..... A63B 63/004 473/478
(Continued)

FOREIGN PATENT DOCUMENTS

FR 2806924 A1 * 10/2001 ..... A63B 71/0605

OTHER PUBLICATIONS

Didier Translation, All Pages (Year: 2001).*
Didier Drawings, All Pages (Year: 2001).*

*Primary Examiner* — John E Simms, Jr.
*Assistant Examiner* — Rayshun K Peng

(57) ABSTRACT

A multimedia crossbar system for goal posts of different spots. The system includes a goal frame, a net, a rear net frame, a multimedia bar, and a transparent display screen. The goal frame includes a front crossbar, a first post, and a second post to yield a U-shape. The rear net frame holds up the net behind the goal frame and includes a rear crossbar, a first rear post, and a second rear post. The multimedia bar includes a support bar, a plurality of lights, a plurality of speakers, and a plurality of sponsor display panels for audiovisual entertainment around the goal frame. The support bar is mounted to the rear crossbar and support the lights, speakers, and the sponsor display panels. The transparent display screen provides another visual medium for advertisement and other similar content. The transparent display screen is positioned and perimetrically connected within the rear net frame.

26 Claims, 17 Drawing Sheets

(51) Int. Cl.

| | |
|---|---|
| ***A63B 71/00*** | (2006.01) |
| ***A63B 43/00*** | (2006.01) |
| ***A63B 71/02*** | (2006.01) |
| *A63B 24/00* | (2006.01) |

(52) U.S. Cl.

CPC ..... *A63B 2071/0658* (2013.01); *A63B 2071/0694* (2013.01); *A63B 2220/12* (2013.01); *A63B 2220/13* (2013.01); *A63B 2220/803* (2013.01); *A63B 2220/806* (2013.01); *A63B 2220/833* (2013.01); *A63B 2220/89* (2013.01); *A63B 2225/50* (2013.01); *A63B 2225/74* (2020.08)

(56) References Cited

U.S. PATENT DOCUMENTS 5,615,880 A * 4/1997 Booth ..... A63B 24/0021 273/371
5,934,679 A * 8/1999 Strain ..... A63B 51/04 273/127 C
9,057,207 B1 * 6/2015 Prendergast ..... E04H 15/006
2003/0181264 A1 * 9/2003 Yoon ..... A63B 71/023 473/421
2004/0038759 A1 * 2/2004 Kuzia ..... A63B 63/00 473/478
2004/0043844 A1 * 3/2004 Hlavin ..... A63B 63/004 473/477
2005/0067785 A1 * 3/2005 Moore, III ..... A63B 63/004 273/407
2006/0032201 A1 * 2/2006 Kisakibaru ..... F24F 9/00 55/498
2006/0273522 A1 * 12/2006 Marshall ..... A63B 71/0605 273/407
2007/0145688 A1 * 6/2007 Caruso ..... A63B 63/004 273/407
2008/0137038 A1 * 6/2008 Winstanley ..... G03B 21/006 353/28
2012/0252606 A1 * 10/2012 Ennis ..... A63B 63/004 473/478
2014/0100062 A1 * 4/2014 Terrell ..... A63B 71/0622 473/477
2016/0107028 A1 * 4/2016 Hartmann ..... H01Q 7/08 324/207.22
2017/0282045 A1 * 10/2017 Glasner ..... A63B 9/00
2017/0368439 A1 * 12/2017 Khazanov ..... A63B 71/0622

* cited by examiner

DETAIL B

DETAIL B

DETAIL B

SHOCK-ABSORBING LIGHT-AND-SIREN, HOLOGRAM PROJECTION ADVERTISEMENT, AND SENSING GOAL POST SYSTEM

The current application claims a priority to the U.S. Provisional Patent application Ser. No. 62/498,586 filed on Jan. 3, 2017.

FIELD OF THE INVENTION

The present invention relates generally to athletic equipment and accessories. More specifically, the present invention is a shock-absorbing goal post with an electronic scoring and advertising display including a hologram projector and sensing system. The present invention provides a means for protecting players for injury through shock-absorbing posts. Additionally, the present invention provides an alternative and novel means for viewing and enjoying a new scoring entertainment solution and advertising projection in professional sporting events in stadium sport field. The present invention may be implemented in a variety of sports including, but not limited to, soccer, handball, American football, rugby, lacrosse, and polo to name a few non-limiting examples.

BACKGROUND OF THE INVENTION

Goal frames in a variety of sports are known to cause injuries to players. This is especially of a high occurrence in soccer as the goal frames are composed of a rigid metal and aluminum and players of the game run at relatively fast speed. Because the purpose of the game is to put the ball through the goal frame, collisions with the goal frame occur frequently, causing injury to the players. The present invention provides a means for reducing the impact force felt by the players in case of these type of collisions. Additionally, the present invention provides a novel means for displaying advertisement, logos placement, lights, and speakers and a screen projector in and around the goal frame which complies with official rules of the sport. These features allow the audience and the players to experience the sport from a novel and new perspective. For example, the present invention includes a plurality of lights to visually indicate the current score of the game.

The present invention also provides the referees and the administrators of the game with useful information when a ball is in the vicinity of the goal frame. In particular, the present invention utilizes a multitude of sensing systems in order to track and determine if the ball truly passed the goal line of the goal frame. One of the sensing systems includes a multitude of cameras integrated into specific areas of the goal. Another sensing system includes a magnetized ball and an electromagnetic shielding bar. The electromagnetic shielding bar is mounted directly behind the goal frame and senses when the magnetized ball has passed the goal line surface thus providing the referee and the administrators with empirical data that a goal was scored.

DETAIL DESCRIPTIONS OF THE INVENTION

All illustrations of the drawings are for the purpose of describing selected versions of the present invention and are not intended to limit the scope of the present invention.

The present invention generally relates to professional sports equipment. In particular, the present invention is a shock-absorbing goal post with an electronic scoring, advertising, and sensing system. The present invention is described in regard to soccer implementation. Although, all aspects of the present invention may be implemented together or separately to alternative sports including, but not limited to, rugby, handball, American football, Polo, field hockey, and other similar sports which utilize goal posts during game play.

Figure 1:
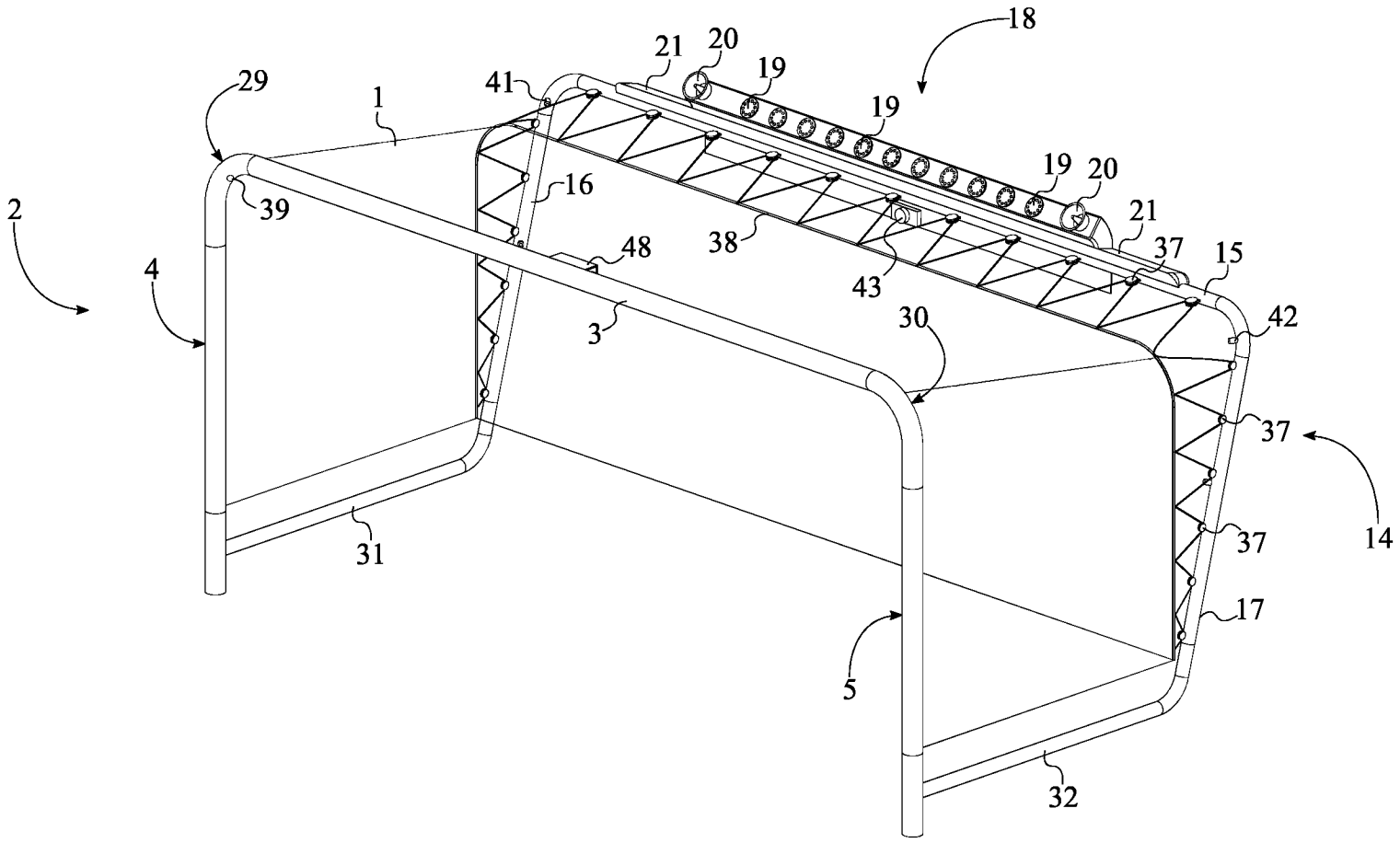
FIG. 1 is a perspective view of the present invention.

Referring to FIG. 1, in the simplest embodiment, the present invention comprises a net 1, a goal frame 2, a rear net frame 14, a multimedia bar system 18, and a transparent display screen 44. The net 1 is a multitude of fabric segments woven together to form a mesh designed to catch the soccer ball in order to prevent the soccer ball from rolling away from the field or possibly hitting a bystander or any other personnel outside of the soccer game. The present invention utilizes a standard design for the net, although alternative designs may also be utilized. The goal frame 2 provides an objective for the players during the soccer game and comprises a front crossbar 3, a first post 4, and a second post 5. The first post 4 and the second post 5 are each a shock-absorbing post designed to absorb large lateral forces such as when a player runs into the either the first post 4 or the second post 5. Simultaneously, the first post 4 and the second post 5 are each designed to act as a traditional ridged post when a smaller lateral force is applied, such as when the soccer ball hits either the first post 4 and the second post 5. In general, the first post 4 and the second post 5 are designed to act as normal post when hit by a ball while simultaneously absorbing shock from a larger force such as a human running into either the first post 4 or the second post 5. This provides players of the game protection against blunt trauma while simultaneously not changing the interaction dynamics in between the soccer ball and the first post 4 and the second post 5. Similar to traditional goal posts, the first post 4 and the second post 5 are mounted in the ground in a vertical orientation. The front crossbar 3 completes the outline of the goal post. The overall design of the goal frame 2 is very similar to traditional goal posts. In particular, the first post 4 is terminally and perpendicularly connected to the front crossbar 3. The second post 5 is positioned parallel and opposite to the first post 4, across the front crossbar 3. Similarly, the second post 5 is terminally and perpendicularly connected to the front crossbar 3. In alternative embodiments of the present invention, the first post 4 and the second post 5 are traditional goal posts.

Figure 2:
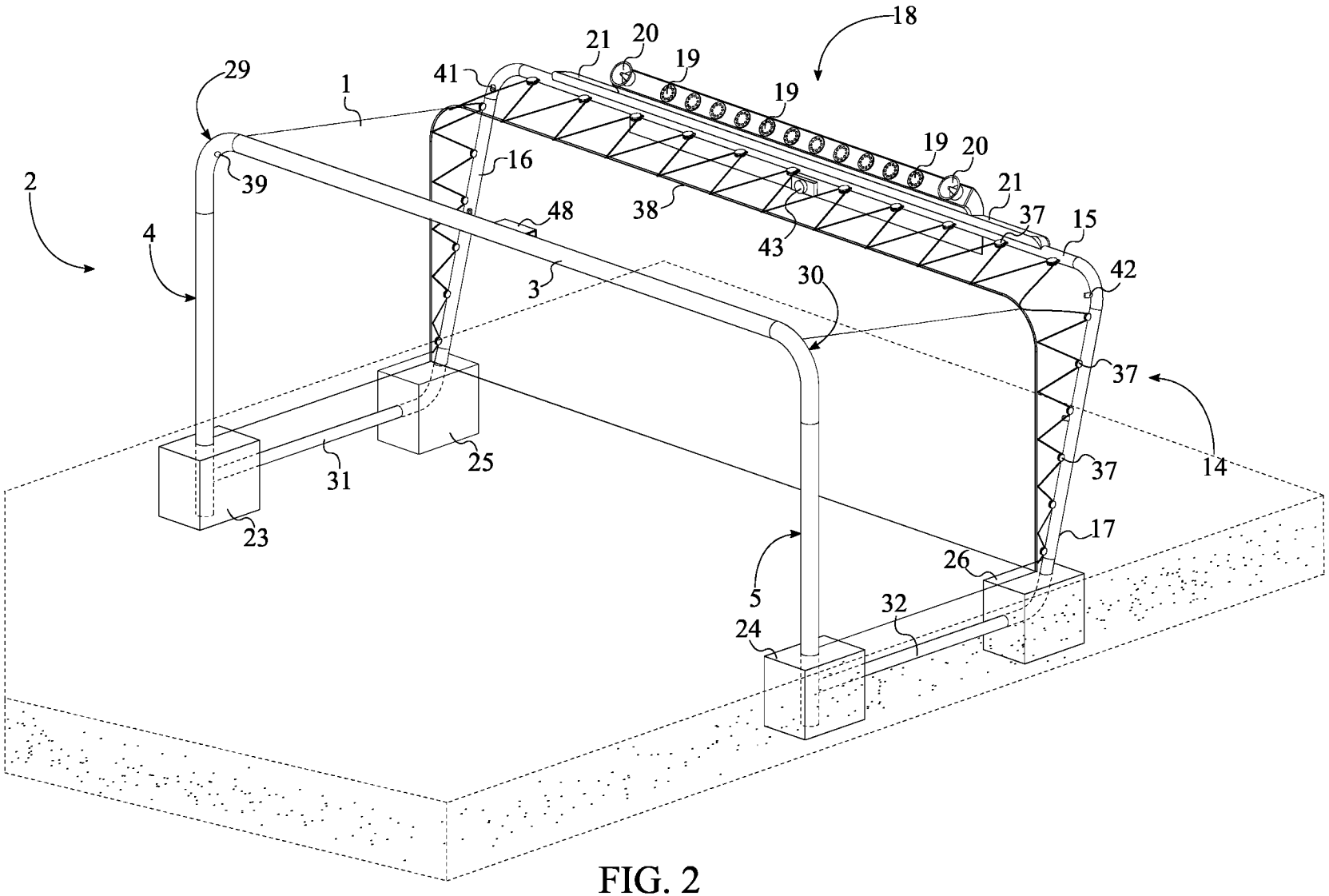
FIG. 2 is a perspective view of the present invention anchored into the ground.
Figure 15:
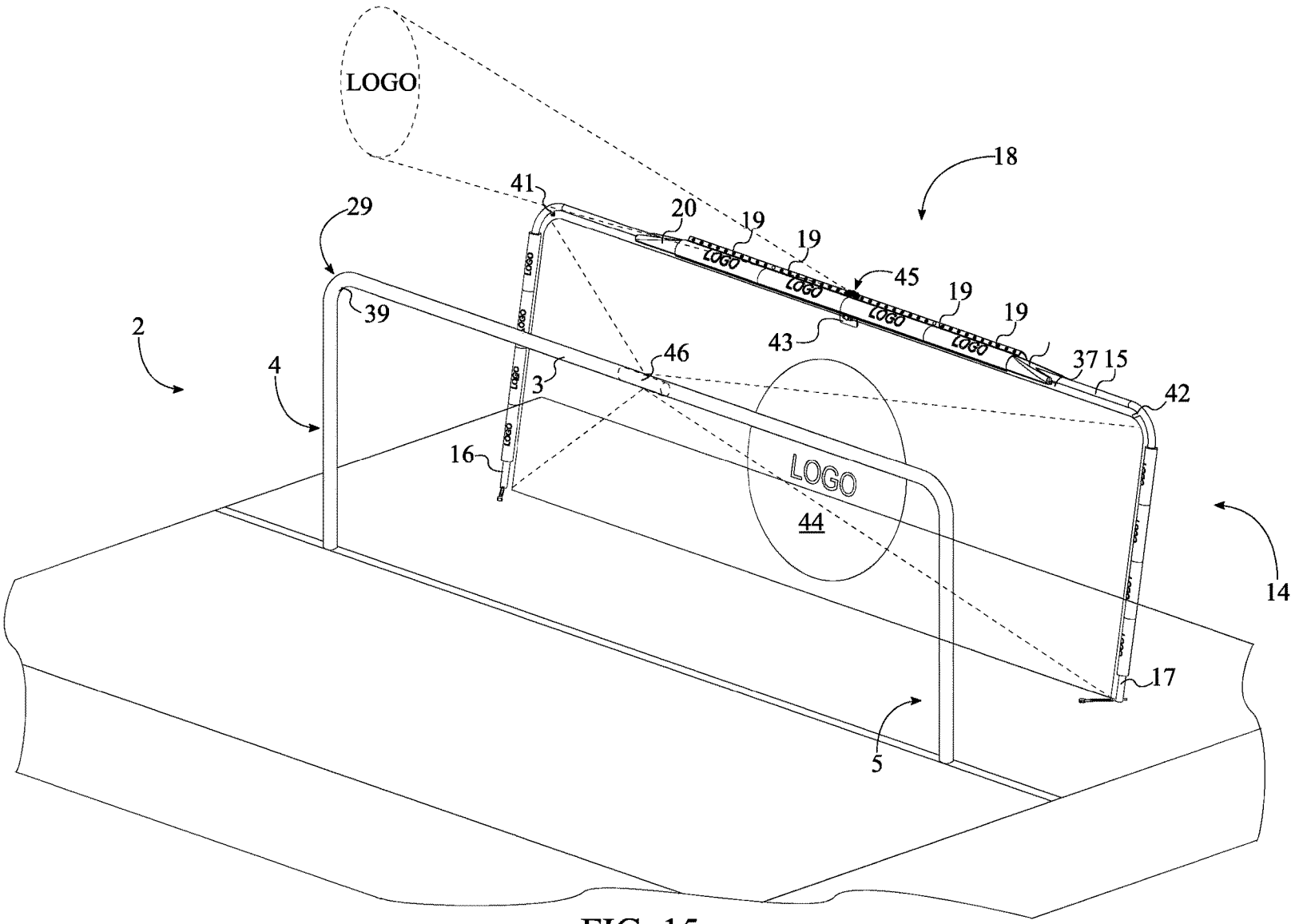
FIG. 15 is a perspective view of an alternative embodiment of the present invention with the net omitted.
Figure 16:
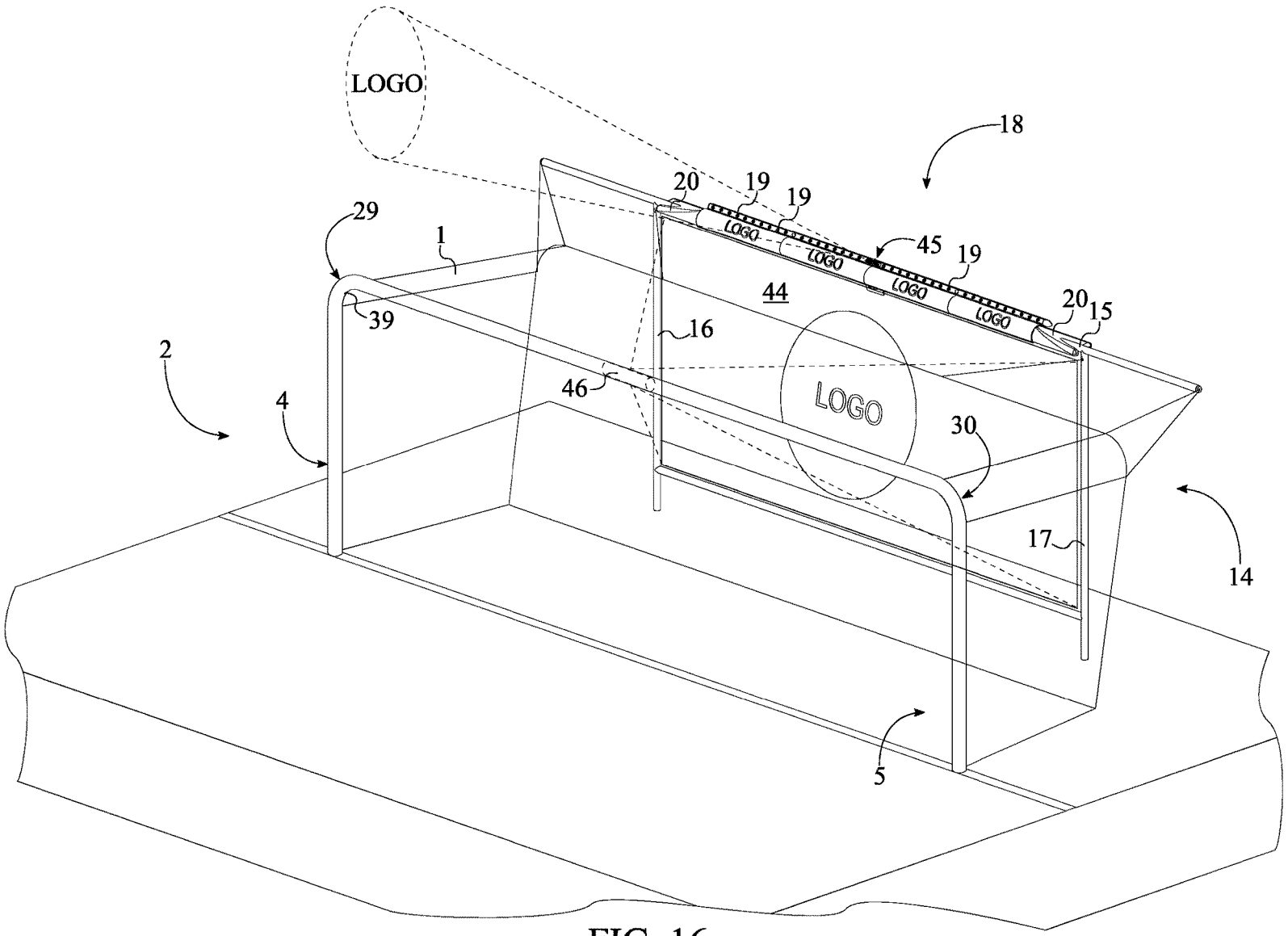
FIG. 16 is a perspective view of an alternative embodiment of the present invention.

The rear net frame 14 is mounted offset to the goal frame 2 and supports the net 1 and the multimedia bar system 18. Additionally, the rear net frame 14 provides an alternative means for logo and advertisement display. The rear net frame 14 comprises a rear crossbar 15, a first rear post 16, and a second rear post 17. Referring to FIG. 2, the rear crossbar 15 of the rear net frame 14 is positioned parallel and offset to the front crossbar 3. The rear net frame 14 is mounted offset to the goal frame 2. Similar to the goal frame 2, the first rear post 16 is terminally and perpendicularly connected to the rear crossbar 15. The second rear post 17 is positioned parallel and opposite to the first rear post 16, across the rear crossbar 15, in order to delineate a U-shaped outline. Additionally, the second rear post 17 is terminally and perpendicularly connected to the rear crossbar 15. This yields an outline which mirrors the goal frame 2 in order to tether and prop up the net 1 in a prism-like shape. In one embodiment of the present invention, the rear net frame 14 further comprises a lower crossbar as seen in FIG. 16. The lower crossbar is positioned parallel and opposite to the rear crossbar 15, across the first rear post 16 and the second rear post 17. Similar to the rear crossbar 15, the lower crossbar is connected in between the first rear post 16 and the second rear post 17. In one embodiment of the present invention, the rear net frame 14 is a U-shaped rear net frame as seen in FIG. 15. In yet another embodiment of the present invention, the rear net frame 14 is a T-shaped rear net frame as seen in FIG. 16. In yet another embodiment of the present invention, the rear net frame is a triangular-shaped rear net frame. Furthermore, in another embodiment of the present invention, the rear net frame 14 comprises two separate T-shaped posts that hold up the net 1. The rear net frame 14 may be straight, partially bent, or fully bent.

The net 1 is positioned in between the goal frame 2 and the rear net frame 14. On one side, the net 1 is perimetrically tether to the goal frame 2. On the other side, the net 1 is perimetrically tethered to the rear net frame 14. As a result, the net 1 is configured into a rectangular prism, similar to traditional designs. It is preferred that the overall profile of the net 1 tapers from the goal frame 2 to the rear net frame 14. Although in alternative embodiments of the present invention, the net 1 tapers from the rear net frame 14 to the goal frame 2 or does not taper at all.

Figure 13:
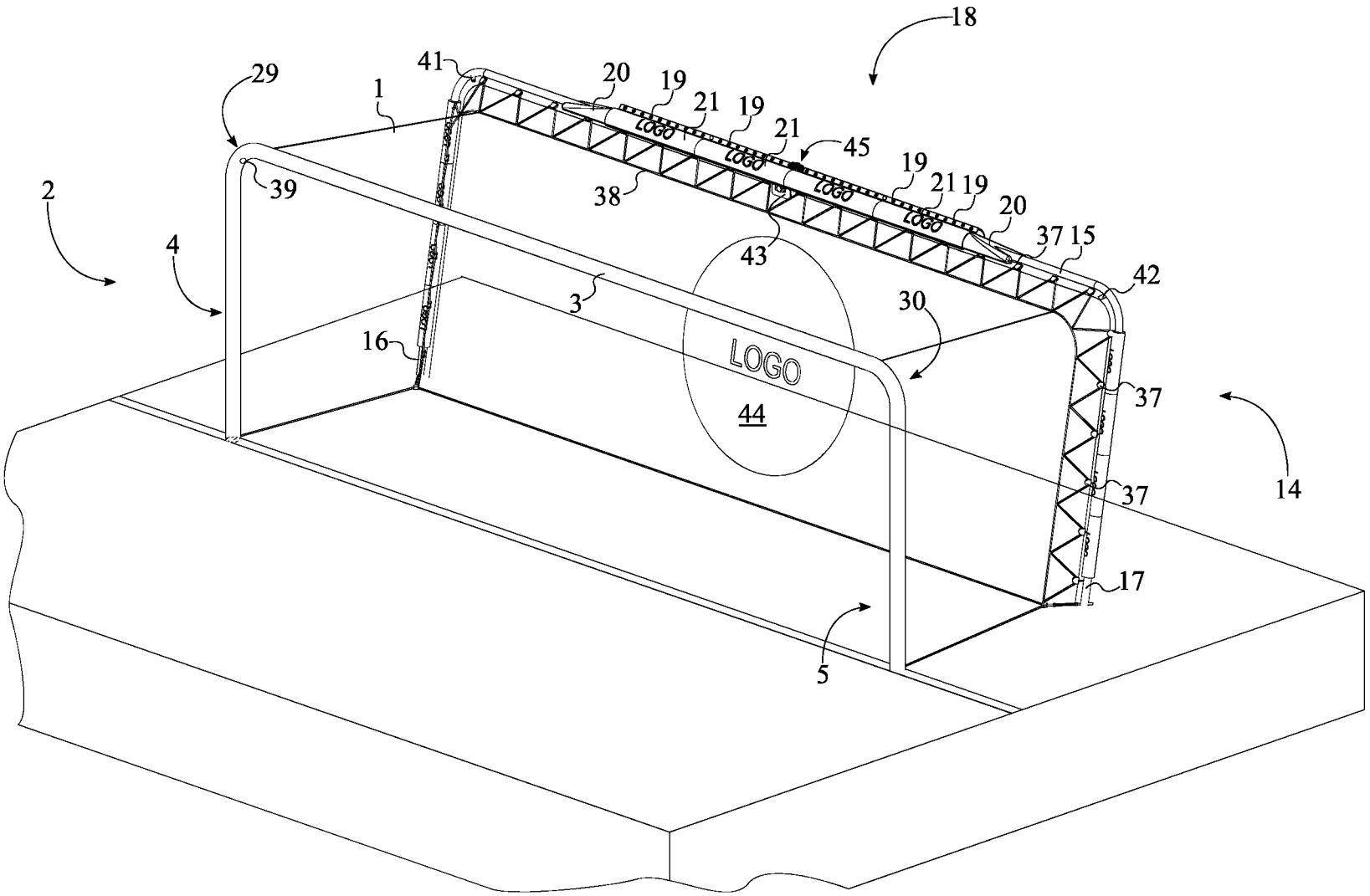
FIG. 13 is an alternative embodiment of the present invention, wherein a support bar is a sponsor display bar panel and a transparent display screen is a logo-imprinted net.

The multimedia bar system 18 provides an alternative means of conveying the score of the game to the audience and the players of the game. In particular, the multimedia bar system 18 convey the score of the game through an audible and visual medium. When a team scores a goal during the game, the present invention activates and produces an audible and visual representation. In order to ensure that the multimedia bar system 18 does not get damaged during game play, the multimedia bar system 18 is adjacently connected to the rear crossbar 15. The multimedia bar system 18 comprises a plurality of lights 19, a plurality of speakers 20, and a support bar 50. The support bar 15 structurally supports the plurality of lights 19 and the plurality of speakers 20. The support bar 50 is positioned parallel and adjacent to the rear crossbar 15 and is connected along the rear crossbar 15. For additional advertising, in one embodiment, the support bar 50 is a sponsor display bar panel as seen in FIG. 13. The plurality of lights 19 provides the visual effect for the present invention and is distributed along the support bar 50; wherein each of the plurality of lights 19 is adjacently connected to the support bar 50. It is preferred that each of the plurality of lights 19 is a long row of powerful and waterproof stadium LEDs, protected by a grill guard mounted over the multimedia bar system 18, although alternative devices may also be utilized. The plurality of lights 19 depicts the current score between the opposing teams. Each time a goal is scored, a specific light of the plurality of lights 19 is turned on, wherein the specific light is associated with the corresponding scoring team. The plurality of speakers 20 provides the audible effect for the present invention and is distributed about along the support bar 50; wherein each of the plurality of speakers 20 is adjacently connected to the support bar 50. It is preferred that each of the plurality of speakers 20 is a powerful and waterproof siren. The plurality of speakers 20 may be used for a variety of purposes including, but not limited to, score announcement, advertisement audio, music, and other similar purposes. It is preferred that each of the plurality of speakers 20 and each of the plurality of lights 19 are oriented towards the front crossbar 3 and the center of the field for maximum visibility, although alternative orientation may also be utilized.

In one embodiment of the present invention, the multimedia bar system 18 further comprises a plurality of sponsor display panels 21. The plurality of sponsor display panels 21 provide an additional medium through which advertisement and other similar content may be displayed to the audience. The plurality of sponsor display panels 21 is distributed along the support bar 50 with each of the plurality of sponsor display panels 21 being adjacently connected to the support bar 50.

The multimedia bar system 18 and other electronic components of the present invention may be directly connected to a power outlet, a battery source, a power generator, or other similar sources.

Figure 8:
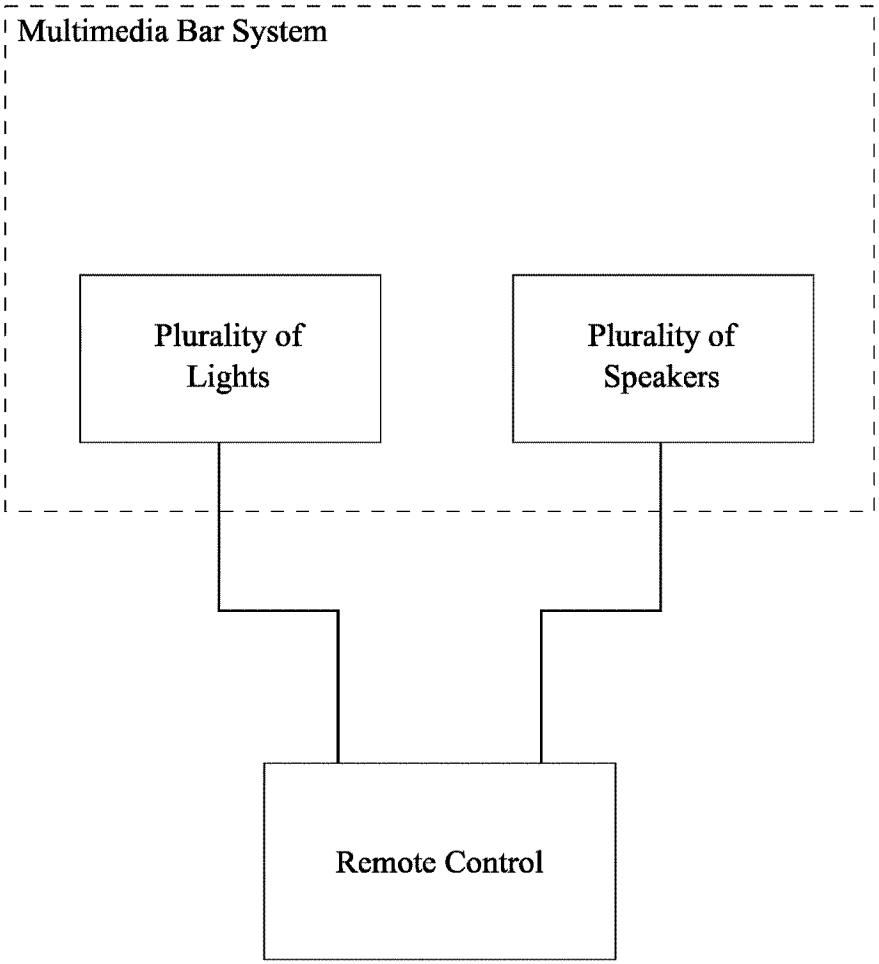
FIG. 8 is a wireless coupling schematic of the present invention.

Referring to FIG. 8, the multimedia bar system 18 is wirelessly controlled by a referee through a remote control 22. The remote control 22 allows the referee to activate and or change the multimedia bar system 18, such as change the score and activate tones/music. Thus, the remote control 22 is communicably coupled the plurality of lights 19 and the plurality of speakers 20. A variety of designs and devices may be used as the remote control 22. It is preferred that the remote control 22 includes two activation buttons which signal the multimedia bar system 18. In order to signal the multimedia bar system 18, both of the activation buttons must be pressed simultaneously. This prevents any accidental activation of the multimedia bar system 18 in case the referee accidentally presses one of the activation buttons. In relation to a soccer game, once the referee activates the remote control 22, the multimedia bar system 18 is preferably activated for ten seconds. This may include music, sounds, lights, and other visual or audible effects to be activated.

Referring to FIG. 2, the goal frame 2 is secured to the ground through a first foundation base 23 and a second foundation base 24. The first foundation base 23 and the second foundation base 24 are each a heavy-duty fastener designed to secure the present invention to the ground. A variety of concrete solutions, mixtures, and other similar substances/mechanisms may be used as the first foundation base 23 and the second foundation base 24. The first foundation base 23 and the second foundation base 24 are used to anchor and secure the goal frame 2 to the ground. In particular, the first foundation base 23 is terminally connected to the first post 4, opposite to the front crossbar 3. Similarly, the second foundation base 24 is terminally connected to the second post 5, opposite the front crossbar 3. This secures and anchors the goal frame 2 such that even upon player/ball impact the goal frame 2 does not bend or fall.

Referring to FIG. 2, the goal frame 2 and the rear net frame 14 may also be secured to the ground through a multitude of means. The first method includes a first anchor bar 31 and a second anchor bar 32. The first anchor bar 31 and the second anchor bar 32 are each an elongated structural member which rigidly connect the goal frame 2 to the rear net frame 14. More specifically, the first anchor bar 31 and the second anchor bar 32 are positioned offset and parallel to each other. In particular, the first anchor bar 31 and the second anchor bar 32 are positioned in between the goal frame 2 and the rear net frame 14. In one embodiment, the first anchor bar 31 and the second anchor bar 32 are buried underground. In another embodiment, the first anchor bar 31 and the second anchor bar 32 are above ground. The first anchor bar 31 is terminally connected in between the first rear post 16 and the first post 4. Similarly, the second anchor bar 32 is terminally connected in between the second rear post 17 and the second post 5. This ensures that goal frame 2 and the rear net frame 14 are secured in a vertical or semi-vertical orientation. It is preferred that the rear net frame 14 is secured to the first anchor bar 31 and the second anchor bar 32 at an obtuse angle. In particular, the first rear post 16 is oriented at a first obtuse angle 33 with the first anchor bar 31. Similarly, the second rear post 17 is oriented at a second obtuse angle 34 with the second anchor bar 32. This orients the rear net frame 14 such that the multimedia bar system 18 is oriented towards the audience and any advertisement/logo being displayed by or through the rear net frame 14 is also oriented towards the audience. In an alternative embodiment, the rear net frame 14 is oriented at a ninety-degree angle with the first anchor bar 31 and the second anchor bar 32.

Referring to FIG. 2, it is preferred that the first anchor bar 31 and the second anchor bar 32 are further anchored underground through a third foundation base 25 and a fourth foundation base 26. The third foundation base 25 and the fourth foundation base 26 secure and anchor the rear net frame 14. The third foundation base 25 and the fourth foundation base 26 are each a heavy-duty fastener designed to secure the present invention to the ground. A variety of concrete solutions, mixtures, and other similar substances/mechanisms may be used as the third foundation base 25 and the fourth foundation base 26. In particular, the third foundation base 25 is connected about the first anchor bar 31, extending the length of the first anchor bar 31. Similarly, the fourth foundation base 26 is connected about the second anchor bar 32, extending the length of the second anchor bar 32. This secures and anchors the rear net frame 14 and the goal frame 2 to the ground.

Figure 10:
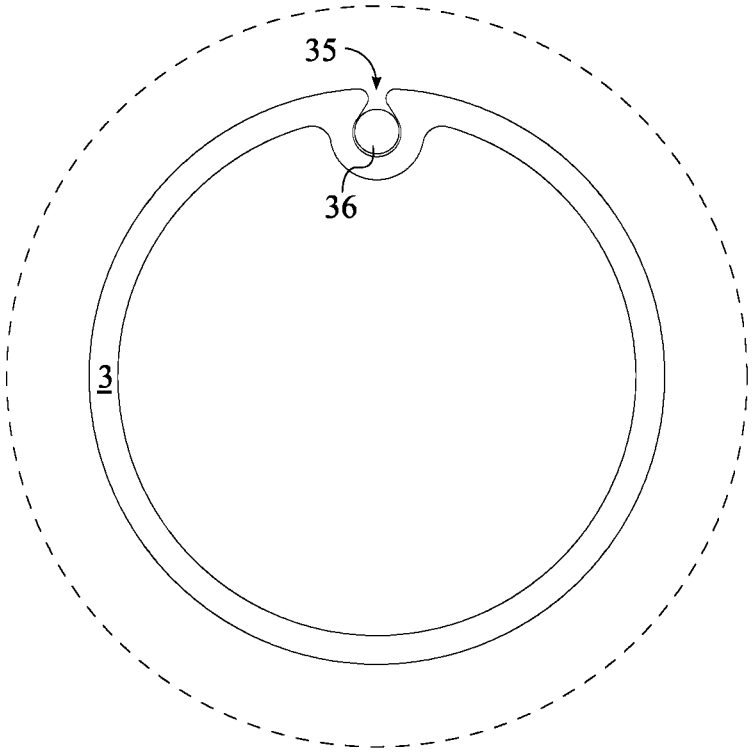
FIG. 10 is a cross-sectional view taken along line B-B in FIG. 3.
Figure 11:
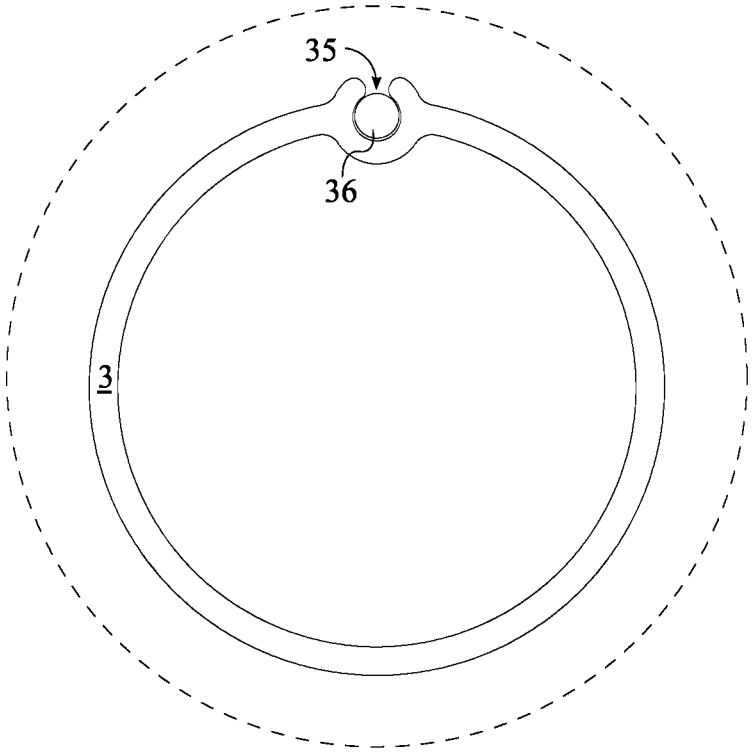
FIG. 11 is a cross-sectional view taken along line B-B in FIG. 3 of an alternative embodiment of the present invention.
Figure 12:
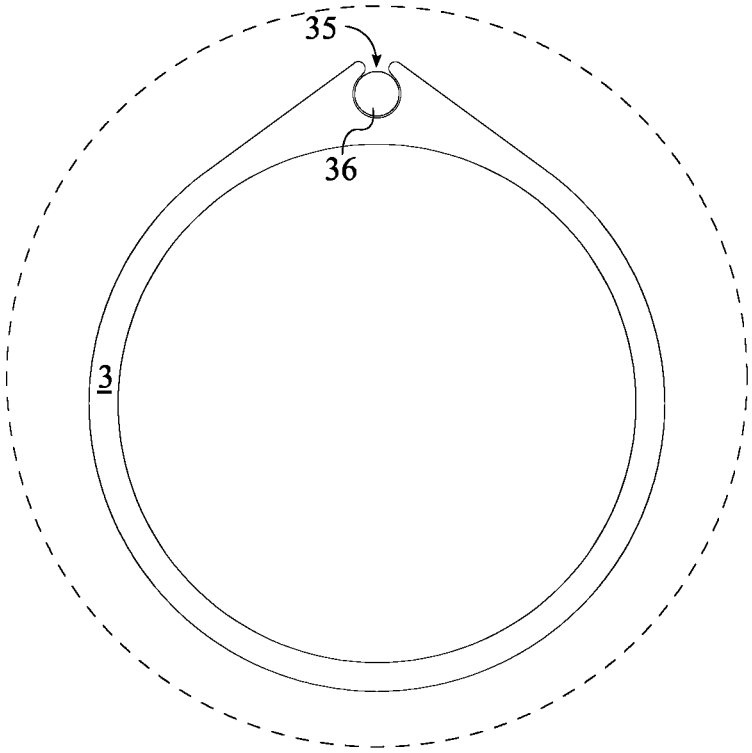
FIG. 12 is a cross-sectional view taken along line B-B in FIG. 3 of an alternative embodiment of the present invention.

The present invention utilizes an alternative means for tethering the net 1 in between the goal frame 2 and the rear net frame 14. In particular, the present invention further comprises a track 35, a first cable 36, a plurality of cable pulleys 37, and a second cable 38. Traditional hook systems attach the net 1 at a multitude of points to the goal frame 2. This is time consuming and require the user to hook the net 1 across the front crossbar 3. The present invention utilizes the first cable 36 and the track 35 in order to allow the user to quickly slide with the help of the handle leash and efficiently attach the net 1 to the non-stick surface of the track 35 all around the goal frame 2. The first cable 36 is perimetrically connected to the front section of the net, opposite the rear net frame 14, and is designed complimentary to the track 35 for a perfect fit. As such, the first cable 36 is capable of sliding along and within the track 35. The track 35 is connected to goal frame 2 and receives the first cable 36. In particular, the track 35 is mechanically integrated along the first post 4, the front crossbar 3, and the second post 5. In order to attach the net 1 to the rear side of the goal frame 2, the track 35 is oriented towards the rear net frame 14. It is preferred that the cross-sectional profile of the track 35 is a semi-circular shape, complimentary to the circular cross-sectional profile of the first cable 36. When the net 1 is attached to the goal frame 2, the first cable 36 is slidably engaged along the track 35. In order to attach the first cable 36 to the track 35 the user feeds one end of the first cable 36 into an opening of the track 35. Then, the user slides the first cable 36 along the track 35 by pulling on the handle leash, mimicking a zipper-like motion. In one embodiment of the present invention, the track 35 is manufactured into the goal frame 2. In this embodiment, an aluminum, with profile extrusion methods, molding process is used to manufacture the first post 4, the second post 5, the front crossbar 3, and the track 35. In another embodiment of the present invention, the track 35 is welded to the goal frame 2. Additionally, the degree of to which the track 35 laterally penetrates into the first post 4, the second post 5, and the front crossbar 3 may vary depending on the user's preferences and needs. Three different degrees are displayed in FIG. 10, FIG. 11, and FIG. 12. More specifically, in one embodiment of the present invention, the track 35 is positioned within the first post 4, the second post 5, and the front crossbar 3 with only a slot being exposed for the receiving of the first cable 36 as seen in FIG. 10. In another embodiment of the present invention, the track 35 is positioned half-way into and out of the first post 4, the second post 5, and the front crossbar 3 as seen in FIG. 11. In yet another embodiment of the present invention, the track 35 is integrated external to the first post 4, the second post 5, and the front crossbar 3 as seen in FIG. 12.

Figure 6:
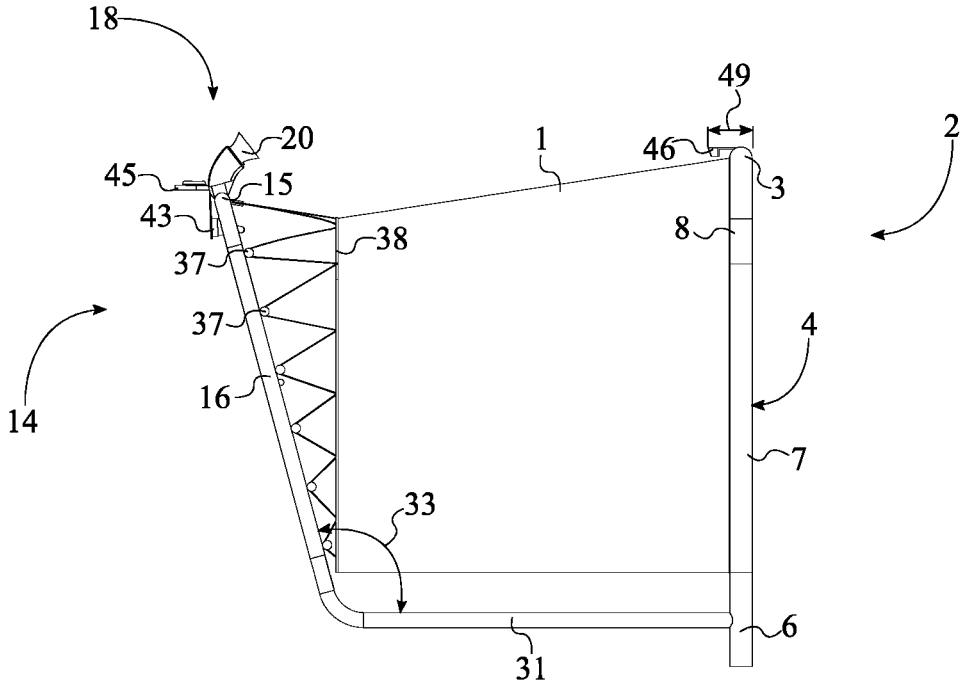
FIG. 6 is a left-side view of the present invention.
Figure 7:
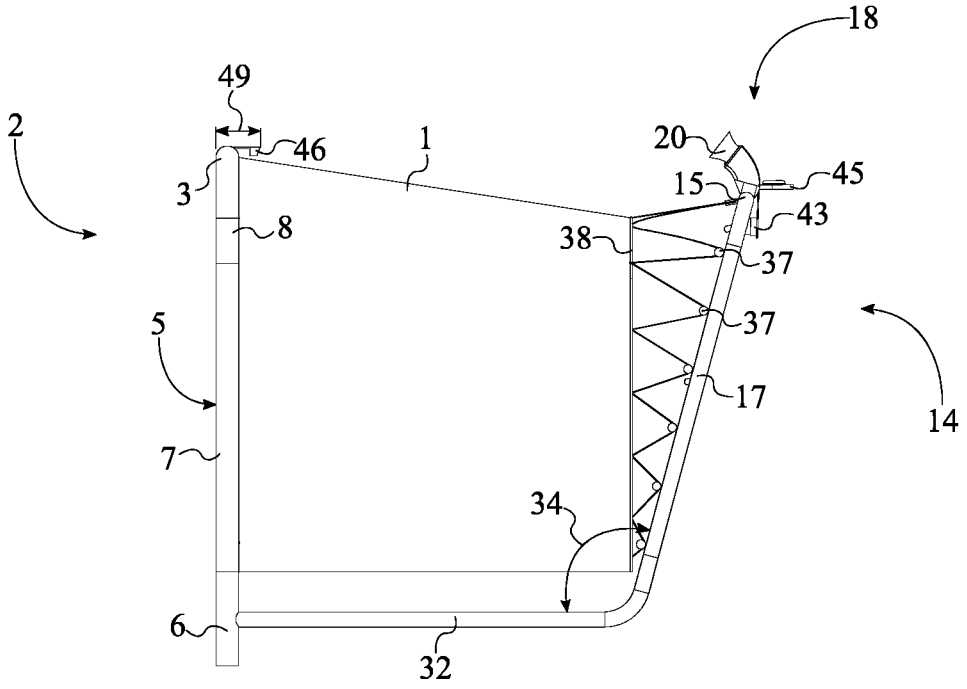
FIG. 7 is a right-side view of the present invention.

Referring to FIG. 6 and FIG. 7, the rear net frame 14 is attached to the back section of the net 1 through a plurality of cable pulleys 37 and the second cable 38. Additionally, the rear net frame 14 is securely placed underground through an underground foundation for additional stability. The plurality of cable pulleys 37 is distributed along the rear net frame 14 with each of the plurality of cable pulleys 37 being adjacently connected to the rear net frame 14. The second cable 38 tethers the back section of the net 1 to the rear net frame 14 through the plurality of cable pulleys 37. In particular, the second cable 38 is tethered to the net 1, opposite the goal frame 2, and is tensionably engaged to the plurality of cable pulleys 37. This ensures equal support for the net 1 instead of two-point engaging implemented in traditional designs. In one embodiment, a third cable may also be integrated into a base of the net. The third cable is a metallic cable that is positioned directly adjacent to the ground, under the grass level. The third cable is connected to a ratchet mechanism which allows the third cable to be tightened to a certain degree. The third cable is connected along the base of the net 1 and ensures that players do not get hurt during gameplay as the third cable is under the grass level to prevents from the ball to potentially exiting from under the net 1 as the present invention does not use traditional lateral tubing. In an alternative embodiment of the present invention, the net 1 is attached to the rear net frame 14 through a plurality of fasteners and a receptive channel, wherein each of the plurality of fasteners comprises a ball, an elastic tether, and a hook. The receptive channel is integrated along the rear net frame 14, either on the interior or the exterior of the rear net frame 14. The plurality of fasteners is distributed along the receptive channel with the ball of each fastener being slidably engaged within the receptive channel. The elastic tether is attached to the ball and the hook is attached to the elastic tether, opposite the ball. The hook attaches to the net, similar to traditional designs. In another embodiment of the present invention, the net 1 is attached to the rear net frame 14 through traditional hooks.

Figure 9:
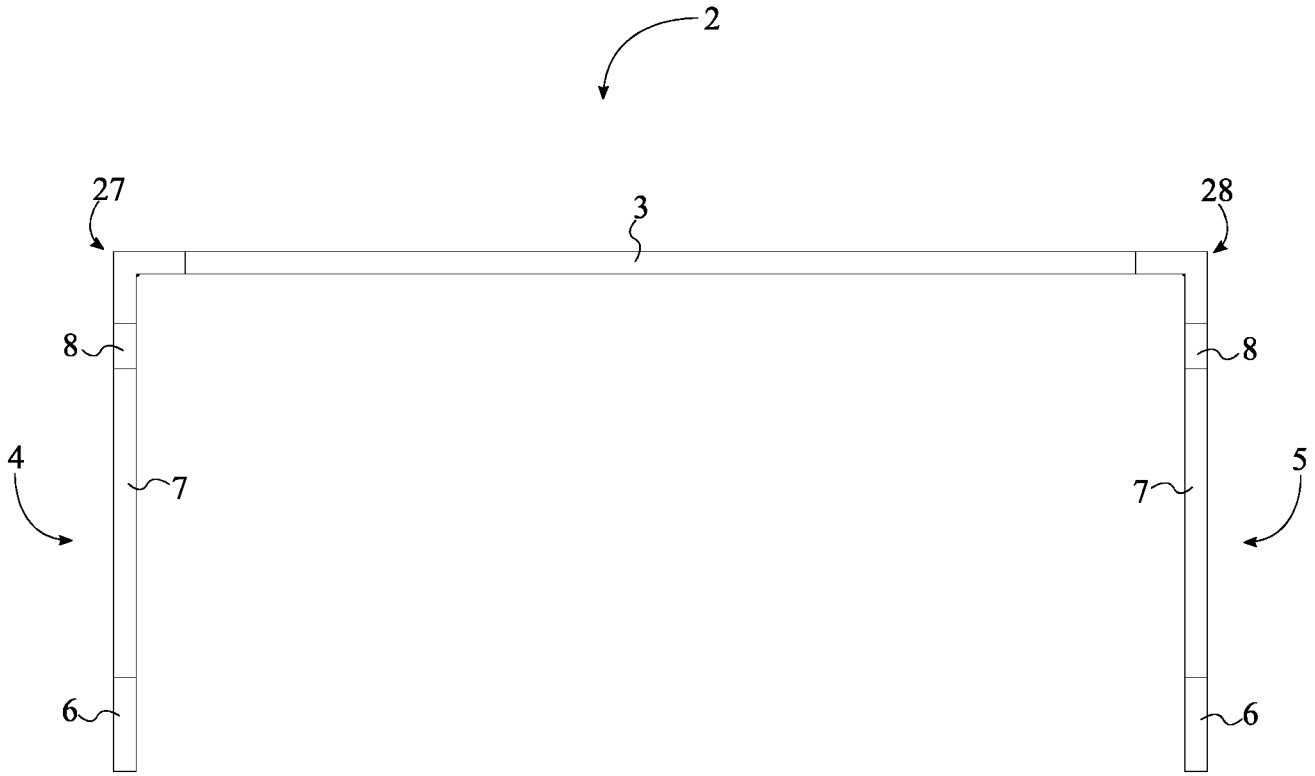
FIG. 9 is a front view of the goal frame from an alternative embodiment of the present invention.

Referring to FIG. 9, in one embodiment of the present invention, the goal frame 2 follows the traditional design. In particular, the first post 4 is connected to the front crossbar 3 by a first right square corner 27. Similarly, the second post 5 is connected to the front crossbar 3 by a second right square corner 28. Referring to FIG. 1, in the preferred embodiment of the present invention, the goal frame 2 is designed with the curvature of the ball in mind. In particular, the first post 4 is connected to the front crossbar 3 by a first rounded corner 29. Similarly, the second post 5 is connected to the front crossbar 3 by a second rounded corner 30. This ensures that the goal frame 2 is designed to the curvature of the ball. In the preferred embodiment of the present invention, the goal frame 2 is easily assembled and disassembled. The front crossbar 3 is composed of the lateral tubing plus the first rounded corner 29 and the second rounded corner 30. The front crossbar 3 is designed to easy detach from the first post 4 and the second post 5.

Figure 3:
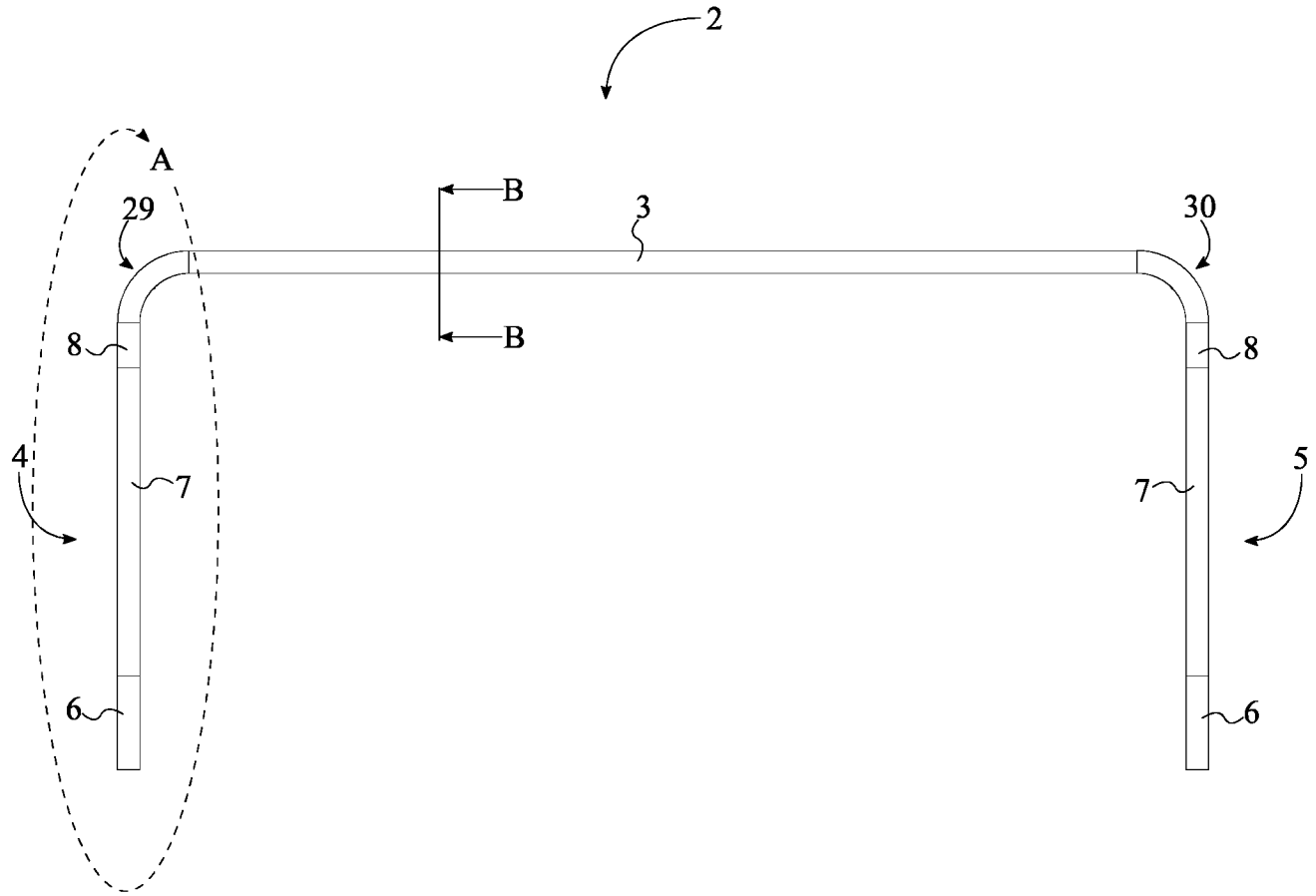
FIG. 3 is a front view of a goal frame of the present invention.
Figure 4:
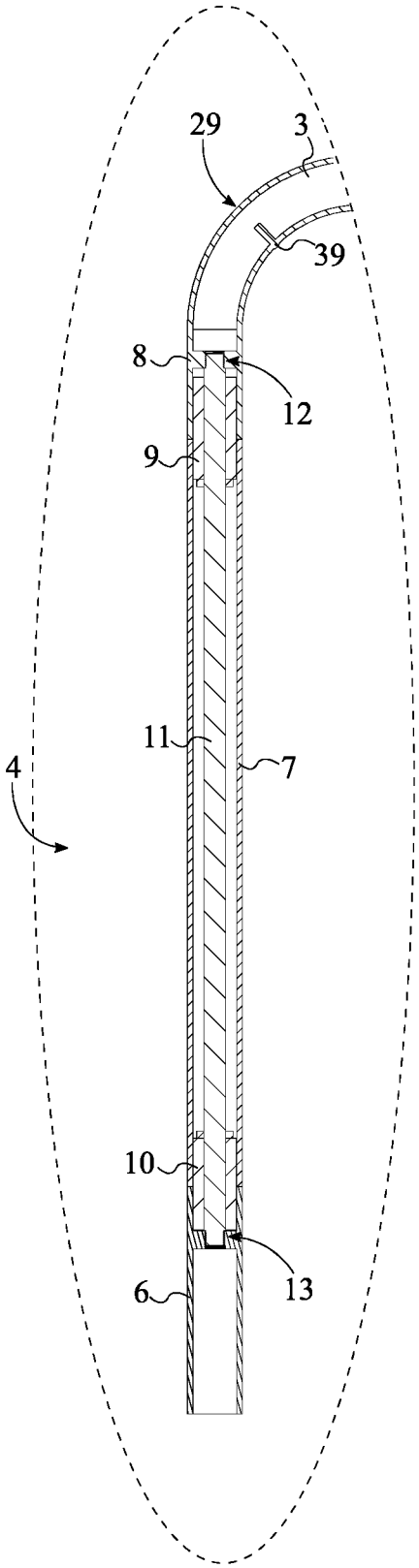
FIG. 4 is a cross-sectional detailed view of the oval A depicted in FIG. 3.
Figure 5:
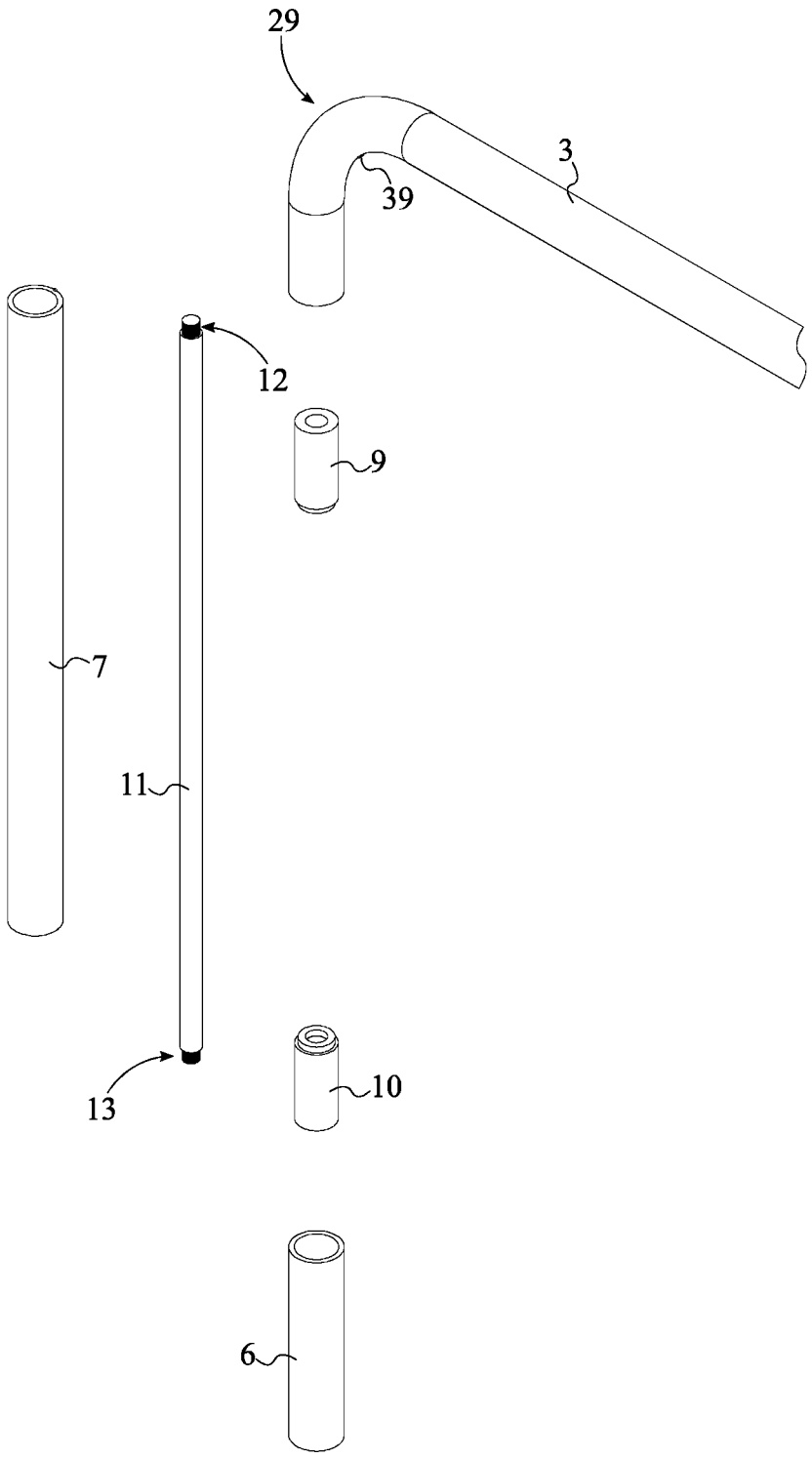
FIG. 5 is a perspective exploded view of the goal frame, depicting the subcomponents of the first post.

Referring to FIG. 3, FIG. 4, and FIG. 5, the first post 4 and the second post 5 each comprise a lower tubular portion 6, an intermediate tubular body 7, an upper tubular portion 8, a first bushing 9, a second bushing 10, and a central shaft 11. The upper tubular portion 8, the intermediate tubular body 7, and the lower tubular portion 6 act as a housing body and thus have the same cross-sectional profile. Thus, the upper tubular portion 8, the intermediate tubular body 7, and the lower tubular portion 6 are positioned concentric with each other. The upper tubular portion 8 connects to the front crossbar 3 while the lower tubular portion 6 is anchored to the ground. The upper tubular portion 8 and the lower tubular portion 6 are positioned opposite to each other along the intermediate tubular body 7. When the present invention is installed, the intermediate tubular body 7 is positioned directly adjacent to the ground and is vertically oriented in order to receive and absorb any blunt force due to a player collision. This is accomplished through the central shaft 11, the first bushing 9, and the second bushing 10. The central shaft 11 is an elongated rod which rigidly connects the lower tubular portion 6 and the upper tubular portion 8 as seen in FIG. 5. The central shaft 11 is concentrically positioned within the upper tubular portion 8, the intermediate tubular body 7, and the lower tubular portion 6 to act as the structural element. In particular, a first end 12 of the central shaft 11 is connected to the upper tubular portion 8. Similarly, a second end 13 of the central shaft 11 is connected to the lower tubular portion 6. The central shaft 11 is preferably connected to the upper tubular portion 8 and the lower tubular portion 6 through a threaded engagement to allow for quick/easy assembly and disassembly.

The first bushing 9 and the second bushing 10 act as dampener elements for the intermediate tubular body 7 and mount the intermediate tubular body 7 to the upper tubular portion 8 and the lower tubular portion 6. In particular, the first bushing 9 and the second bushing 10 are each a tubular extrusion sized to fit over the central shaft 11 and within the upper tubular portion 8, the intermediate tubular body 7, and the lower tubular portion 6. Additionally, the first bushing 9 and the second bushing 10 are each composed of a rubber-type material capable of partial deformation. The first bushing 9 acts as a dampener for a top end of the intermediate tubular body 7. Thus, the first bushing 9 is positioned within the upper tubular portion 8 and the intermediate tubular body 7. More specifically, the first bushing 9 is mounted about the central shaft 11, adjacent to the first end 12 of the central shaft 11. In general, the first bushing 9 attaches the top end of the intermediate tubular shaft to the upper tubular portion 8 and the central shaft 11 as well. The second bushing 10 acts as a dampener for a bottom end of the intermediate tubular body 7. Thus, the second bushing 10 is positioned within the lower tubular portion 6 and the intermediate tubular body 7. More specifically, the second bushing 10 is mounted about the central shaft 11, adjacent to the second end 13 of the central shaft 11. In general, the second bushing 10 attaches the bottom end of the intermediate tubular shaft to the lower tubular portion 6 and the central shaft 11 as well.

This configuration allows the intermediate tubular body 7 to partially translate perpendicular to a central axis of the intermediate tubular body 7. When a player runs into or collides with the intermediate tubular body 7, the force from the hit partially deforms the first bushing 9 and the second bushing 10. Resultantly, the intermediate tubular body 7 laterally translates/give in response to the collision. This in turn decreases the overall physical impact on the player and thus reduces the chance that an injury will occur from the collision. After which, the first bushing 9 and the second bushing 10 return to an initial expanded state. The degree of deformation of the first bushing 9 and the second bushing 10 is dependent on the size of the impact and the location of the impact. In alternative embodiments of the present invention, the first bushing 9 and the second bushing 10 may each comprise a multitude of individual bushings. This allows for easier assembly of the goal frame 2. If the impact occurs closer to the first bushing 9, then the majority of the dampening and deformation will occur with the first bushing 9. If the impact occurs closer to the second bushing 10, then the majority of the dampening and deformation will occur with the second bushing 10. Additionally, this design ensures that the first post 4 and the second post 5 each act independently when struck by an item or a player. Furthermore, the first post 4 and the second post 5 each work equally from all sides.

Referring to FIG. 1 and FIG. 13, the present invention also utilizes a sensing system in order to accurately track and determine if a goal was scored. The sensing system includes a first weather-resistant camera 39, a second weather-resistant camera 40, a third weather-resistant camera 41, and a fourth weather-resistant camera 42. The first weather-resistant camera 39, the second weather-resistant camera 40, the third weather-resistant camera 41, and the fourth weather-resistant camera 42 are each also designed to withstand a certain amount of shock or may be enclosed in an anti-shock case in order to prevent damage in case of direct impact. The sensing system allows referees and other officials the ability to review the play in slow motion from a variety of different angles to determine whether a goal was scored or not. The first weather-resistant camera 39, the second weather-resistant camera 40, the third weather-resistant camera 41, and the fourth weather-resistant camera 42 are each an optical device capable of recording and capturing graphical images; and, are weather proof and shock proof to ensure durability throughout a variety of weather conditions. Additionally, the first weather-resistant camera 39, the second weather-resistant camera 40, the third weather-resistant camera 41, and the fourth weather-resistant camera 42 are each mounted within a corresponding shock absorbing case in order to ensure a clear and stable picture/video.

The first weather-resistant camera 39 is mechanically integrated in between the first post 4 and the front crossbar 3. In particular, the first weather-resistant camera 39 is integrated into the corner between the first post 4 and the front crossbar 3. The first weather-resistant camera 39 is internally mounted within the goal frame 2 with the lens portion being positioned flush with the external surface of the goal frame 2. This ensures that the first weather-resistant camera 39 does not change or alter the dynamics of the game. Additionally, the first weather-resistance camera 39 is oriented towards the second post 5 and the goal line of the goal frame 2. This provides the referee and the officials with clear coverage of the ball passing or not passing the goal line, adjacent to the second post 5.

The second weather-resistant camera 40 is mechanically integrated in between the second post 5 and the front crossbar 3. In particular, the second weather-resistant camera 40 is integrated into the corner between the second post 5 and the front crossbar 3. The second weather-resistant camera 40 is internally mounted within the goal frame 2 with the lens portion being positioned flush with the external surface of the goal frame 2. This ensures that the second weather-resistant camera 40 does not change or alter the dynamics of the game. Additionally, the second weather-resistance camera 40 is oriented towards the first post 4 and the goal line of the goal frame 2. This provides the referee and the officials with clear coverage of the ball passing or not passing the goal line, adjacent to the first post 4.

The third weather-resistant camera 41 is mechanically integrated in between the first rear post 16 and the rear crossbar 15. In particular, the third weather-resistance camera 41 is integrated into the corner between the first rear post 16 and the rear crossbar 15. The third weather-resistant camera 41 may be internally or externally mounted. The third weather-resistant camera 41 is oriented towards the goal frame 2 in order to provide the referee and the officials with a view of the goal frame 2 from behind the net.

The fourth weather-resistant camera 42 is mechanically integrated in between the second rear post 17 and the rear crossbar 15. In particular, the fourth weather-resistance camera 42 is integrated into the corner between the second rear post 17 and the rear crossbar 15. The fourth weather-resistant camera 42 may be internally or externally mounted. The fourth weather-resistant camera 42 is oriented towards the goal frame 2 in order to provide the referee and the officials with a view of the goal frame 2 from behind the net 1. The first weather-resistant camera 39, the second weather-resistant camera 40, the third weather-resistant camera 41, and the fourth weather-resistant camera 42 are each electrically connected to a power source such as a battery, or an electric outlet. Additionally, the first weather-resistant camera 39, the second weather-resistant camera 40, the third weather-resistant camera 41, and the fourth weather-resistant camera 42 are each electronically connected to an external computing device which receives and displays the video playback.

In one embodiment, the present invention may further comprise an at least one master panoramic camera 43. The master panoramic camera 43 is centrally mounted to the rear net frame 14. Additionally, the master panoramic camera 43 is oriented towards the goal frame 2 in order to provide the referee and the officials with a clear view behind the net 1, directly behind the goal keeper. The master panoramic camera 43 is a high resolution panoramic video recording camera that preferably includes a display screen and a wide-angle lens in order to cover the whole goal line surface. This provides the referee with an option to instantly review the play in order to determine an official decision based on additional evidence. It is preferred that the first weather-resistant camera 39, the second weather-resistant camera 40, the third weather-resistant camera 41, and the fourth weather-resistant camera 42 are all communicably coupled to the master panoramic camera 43 such that the referee may view the shot from each of the views through the master panoramic camera 43. In one embodiment of the present invention, the at least one master panoramic camera 43 comprises a top panoramic camera and a bottom panoramic camera. In this embodiment, the top panoramic camera is positioned adjacent to the rear crossbar 15 while the bottom panoramic camera is positioned opposite to the top panoramic camera, across the first rear post 16, essentially positioning the bottom panoramic camera adjacent to the ground. The master panoramic camera 43 may be mounted on an adjustable leg which can extend, rotate, and tilt.

The present invention may also comprise a sixth weather-resistant camera and a seventh weather-resistant camera assembly. The sixth weather-resistance camera is a radar laser field projector that is centrally mounted to the rear net frame 14 and tracts the ball when the ball crosses the goal line. The seventh weather-resistant camera assembly is mounted to the front crossbar 3 and comprises five different cameras spanning the goal line surface, from underneath the crossbar in order adequately capture the ball passing or not passing the goal line. Similarly, the sixth weather-resistant camera and the seventh weather-resistant camera assembly may also be linked to the master panoramic camera 43.

Figure 17:
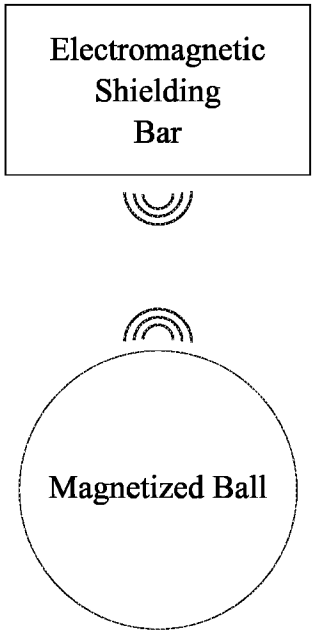
FIG. 17 is a wireless coupling schematic of the present invention depicting the coupling between a magnetized ball and an electromagnetic shielding bar.

Referring to FIG. 1 and FIG. 17, the sensing system further utilizes an at least one electromagnetic shielding bar 47 and a magnetized ball 48. The electromagnetic shielding bar 47 acts as a sensor in order to identify if and or when the magnetized ball 49 passes the goal line. For this, the electromagnetic shielding bar 47 is positioned in between the goal frame 2 and the rear net frame 14, parallel to the front crossbar 3. Additionally, the electromagnetic shielding bar 47 is mounted to the net 1, adjacent and offset to the front crossbar 3. In particular, the electromagnetic shielding bar 47 is positioned behind the front crossbar 3 between the top section of the net 1 and the top edge on the front crossbar 3 with a thickness of maximum five centimeters to meet standard regulations (Professional Ball size 5) with the soccer ball circumference to be 68 centimeters to 70 centimeters. To accurately sense the magnetized ball 48 passing the goal line fully, a requirement for a goal in soccer, the electromagnetic shielding bar 47 is positioned a first distance 50 from the front crossbar 3. For major league soccer embodiment of the present invention, the first distance 49 is equal to the width of a full-size soccer ball, which is between 21.6 centimeters and 23 centimeters; this is the official size of a soccer ball wherein the circumference is between 27 and 28 inches (69 to 71 centimeters). The magnetized ball 48 is composed of magnetized threading and electromagnetic-field-shielding fabric, or Señor stitching treads, and is thus communicably coupled to the electromagnetic shielding bar 47. As a result, when the magnetized ball 48 passes the electromagnetic shielding bar 47, the magnetic field set up by the electromagnetic shielding bar 47 will be triggered. This registers with an external computing device, indicating that the magnetized ball 48 has fully passed the goal line. In one embodiment of the present invention the at least one electromagnetic shielding bar 47 may comprise a pair of shielding bars. The pair of shielding bars are positioned parallel and offset to each other across the goal frame 2. In one embodiment, the pair of shielding bars is positioned adjacent and parallel to the first post 4 and the second post 5. In another embodiment of the present invention, the pair of shielding bars are positioned parallel to the front crossbar 3. In yet another embodiment of the present invention, the electromagnetic shielding bar 47 is U-shaped and is mounted directly behind the goal frame 2. In particular, the electromagnetic shielding bar 47 is pivotably mounted to the goal frame 2 such that upon impact, the electromagnetic shielding bar 47 pivots away from the goal frame 2 and does not interfere with the ball dynamics of the magnetized ball 48.

Referring to FIG. 13, the present invention further provides an alternative means for displaying advertisement. This is achieved by the transparent display screen 44. The transparent display screen 44 is a thin sheet/film of see through material the is positioned in between the first rear post 16 and the second rear post 17. Additionally, the transparent display screen 44 is perimetrically connected to the rear net frame 14. This configuration ensures that there are no visual obstructions behind the goal frame 2 for the players of the game while simultaneously the audience further away receive a visual advertisement. The logo image, the visual advertisement, can be oriented towards the field. Additionally, the logo image, the visual advertisement can be translucent where the directly behind the present invention can still see through and inside the net 1. In one embodiment, advertisement and other similar content is printed directly onto the transparent display screen 44. In this embodiment, the transparent display screen 44 is composed of perforated window vinyl film, although alternative compositions may be utilized.

In another embodiment of the present invention, the transparent display screen 44 is a logo-imprinted net. The logo-imprinted net is a mesh-like device woven from a multitude of stretchable fibers. Drawn on the individual fibers are portions of a logo or other similar advertisement. The logo-imprinted net is transparent when viewed from a close distance. From a further distance, the drawn logo or other advertisement may be seen on the logo-imprinted net. In another embodiment of the present invention, the rear net frame 14 and the transparent display screen 44 may be positioned offset to the goal frame 2 without holding up the net 1.

Figure 14:
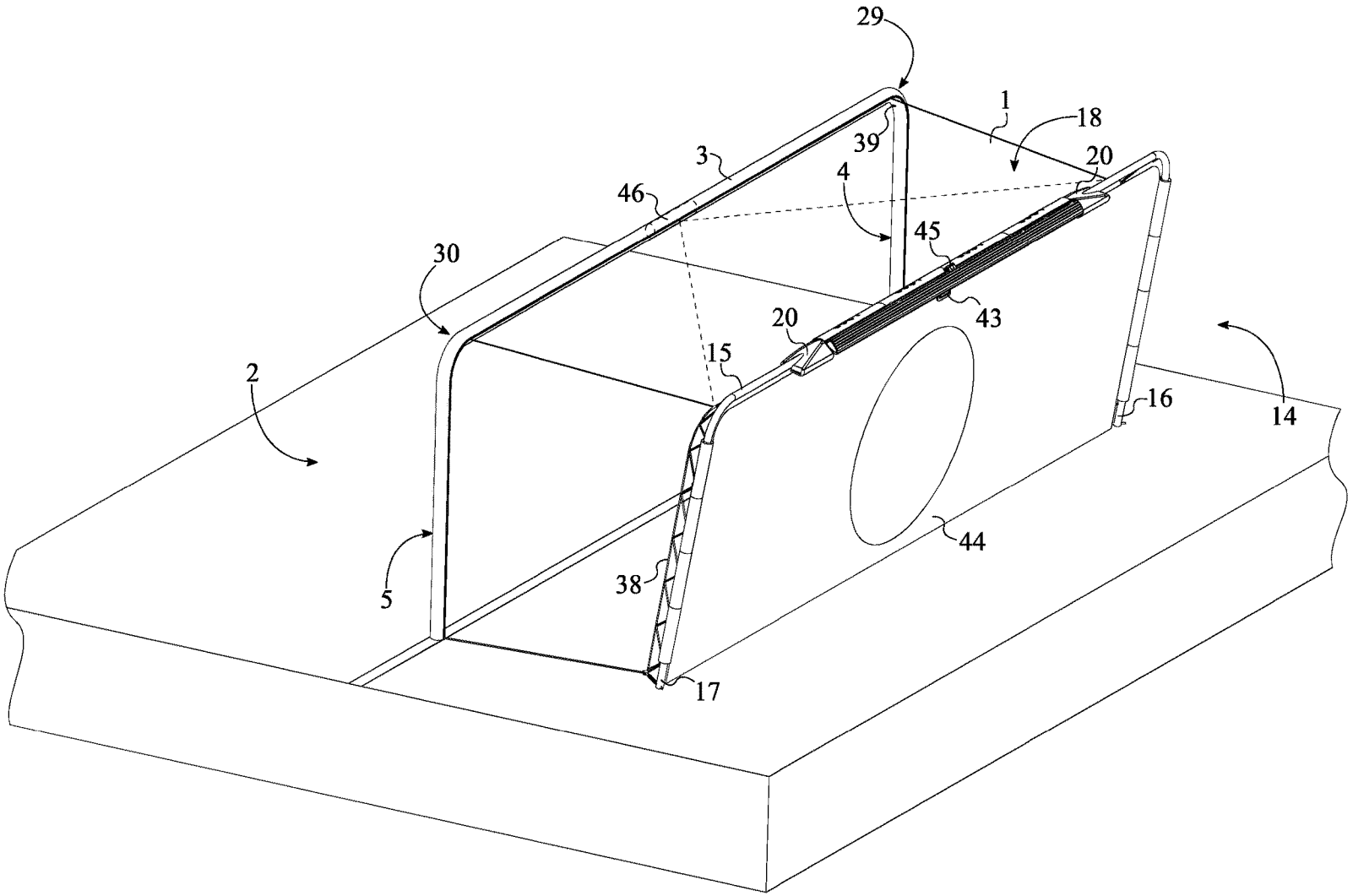
FIG. 14 is a rear perspective view of an alternative embodiment of the present invention.

Referring to FIG. 14 and FIG. 15, in another embodiment of the present invention, a similar affect is achieved through the transparent display screen 44 and a projection device 46. The projection device 46 is an optical device which projects an image or a set of images onto a projection screen. The transparent display screen 44 acts as the projection screen for the projection device. For this, the transparent display screen 44 may be vinyl film, net meshing, or any other medium capable of receiving projected content. As such, the projection device 46 is centrally mounted within the front crossbar 3 and is oriented towards the transparent display screen 44 as seen in FIG. 14 through FIG. 16. This configuration may be used to display a logo/advertisement image, a three-dimensional logo/advertisement, play a commercial, or be used for other video playback purposes. In another embodiment of the present invention, the projection device 46 may be mounted behind the rear net frame 14, opposite the goal frame 2.

In another embodiment of the present invention, a pivoting three-dimension hologram projector 45 is used to display a logo and or advertisement. The pivoting three-dimension hologram projector 45 is centrally and externally mounted to the rear crossbar 15 of the rear net frame 14. Additionally, the pivoting three-dimension hologram projector 45 is protected by a guard cover. The pivoting three-dimension hologram projector 45 is oriented towards the ground and projects a three-dimensional image to the space in between the first rear post 16, the second rear post 17, and the rear crossbar 15. Alternatively, the pivoting three-dimension hologram projector 45 may display directly above the goal frame 2 as seen in FIG. 15. In general, the pivoting three-dimension hologram projector 45 is capable of rotating and tilting in order to display a three-dimension hologram anywhere around the present invention.

In one embodiment, the pivoting three-dimension hologram projector 45 is preferably mounted to the crossbar of the posts of soccer, American football, rugby, polo and handball goal post frame.

This allows the pivoting three-dimension hologram projector 45 to be oriented towards the sky and above the field and over and above the goal frame 2, in particular towards the top center of the sport stadium field to project large and very large images and videos in midair. This is not limited to professional sports events and discipline from all types of professional sports, including water sports and no water sports. Type of content that the pivoting three-dimension hologram projector 45 may display includes, but is not limited to, replay of the most recent goal, three dimensional images of sports team and player t-shirt, jersey or sports team logo associated with the most recent scored goal, advertisements, and other similar content above the goal frame 2. A hologram programmer or other administrative staff is in charge of content being displayed by the pivoting three-dimension hologram projector 45. More specifically, a staff member of each professional sport club is in charge to manage both team's Jersey/T-shirts and ready for projection when a goal is scores. Additionally, the pivoting three-dimension hologram projector 45 may be activated alongside with the multimedia bar system 18.

The professional sports Jersey/T-Shirt and the digital 3D Jersey projection has the same use for each game and each team in the professional sports stadiums or sports racing tracks, and design to match the same professional sports player T-shirt and Jersey at 100% from the color, design, the name and number of the player, logo of the clubs and the name and logo of the sponsor. This feature may be used to project a variety of different t-shirts and jerseys. For example, garments with short sleeves, long sleeves, and no sleeves may be projected. Additionally, this feature may be used in a variety of professional sports including, but not limited to soccer, American football, NFL, basketball, NBA, rugby, handball, polo, hockey, car racing horse racing, Olympic sports, winter sports, and water sports to name a few non-limiting examples.

In another embodiment of the present invention, a hologram plasma laser used to project a three-dimensional image. The hologram plasma laser ionizes molecules at specific points in the air in order to create visible plasma bursts as said points. A multitude of these plasma bursts create an image in empty space. The hologram plasma laser is mounted between the first rear post 16 and the second rear post 17 in order to project a logo/advertisement image or a multitude of images directly within the rear net frame 14. Additionally, the hologram plasma laser can be place on a base and into the group and behind the goal post frame to project three-dimensional image oriented toward to the rear U-shaped open space. In one embodiment, any of the hologram devices may be used to display the score of the game, logos, and advertisements. As such, the content being projected may be viewed from a variety of angles such as the front and the rear of the present invention.

In another embodiment of the present invention, the rear net frame 14 can also be a stand-alone component that may be placed and positioned on the ground behind the goal frame 2 of any standard stadium goal frame 2 for the purposes of projecting advertisement and entertainment. In this embodiment, the multimedia bar system 18, the hologram projector device 45, the transparent display screen 44, and or the laser plasma projector may be integrated into the rear net frame 14. The rear net frame 14 may be positioned on the grass or be anchored into the ground like a giant free advertising board stand. Additionally, the rear net frame 14 is designed to receive virtual advertising images directly to the transparent display screen 44.

In one embodiment, the present invention is implemented as a handball goal post. In this embodiment, the goal frame 2 is connected to the rear net frame 14 by the first anchor bar 31 and the second anchor bar 32. Although, unlike the soccer goal post embodiment, the first anchor bar 31 and the second anchor bar 32 are positioned above ground. In this embodiment, only the first post 4 and the second post 5 are fit within an underground foundation through two holes. Additionally, the net 1 has a conical design, tapering from the goal frame 2 towards the rear net frame 14. Furthermore, the base of the net 1 includes three long sleeves which receive a ground cable to fit perfectly around and inside the net 1, keeping the net 1 tighten with the ground through a tensioned knob. This prevents the ball from escaping under the net 1 regardless of the speed and force of the ball. The base of the net 1 is attached to the ground with a single steel or cord cable. The steel cable is attached to the first post 4 and the second post 5, below the entrance of the channel for the first cable 36. In one embodiment, the present invention further comprises a pair of adjustment knobs. The adjustment knobs are located at the base corners of the rear net frame 14 and are engaged to the steel cable. Turning the adjustment knobs tightens or releases the steel cable. In an alternative embodiment of the present invention, the net 1 may be a conical shape with a narrow back section. Another shaped includes a traditional triangle shape with a size 24' wide×8' tall and 6' deep and attached to the rear net frame 14.

The first post 4 and the second post 5 can be made with different tube shape from round, oval, elliptical shape also each shape may have integrated channel track for the net 1 attachment with the sliding cable. Additionally, the integrated channel track may be designed to facilitate the insertion of the cable. In the preferred embodiment, the goal frame 2 is designed to be easily disassembled, transported, and installed.

In an alternative embodiment, the present invention design and functionality can be made in smaller size, made to be lightweight, compact, foldable and portable for easy to carry on any a large bag and in a car truck; like a tent for practice and game play on any ground surface and only required a smaller space like parks, beaches, backward, parking space and small indoor arena. Thus, the present invention offers the same excitement and entertainment values just like the stadium goal post. The invention concept can also be made in mini size and sit on the ground like a tent on any surfaces, with easy to carry and to assembly for outdoor parks, beaches, and in door arenas.

In an alternative embodiment, the present invention may be implement as a digital game machine. In this embodiment, the present invention is designed smaller in order to be placed in a standing position on top of a table or on the ground. The present invention may also include a shooting player and a goalie operated by a handle grip. This allows a user to practice his or her reflexes while enjoying the game. When the magnetized ball 49 enter the goal frame 2, all electronic features will be activated. In a further alternative embodiment, the present invention is implemented as a digital video game.

In one embodiment of the present invention, the first post 4 and second post 5 having Gooseneck to the top end with attached to the front crossbar 3. In one embodiment, a panoramic video radar camera is attached to the rear net frame 14 design to follow and tracking all movements and speed of the ball and the magnetic ball from distance like a GPS during the entire game. In one embodiment, the master panoramic camera 43 is mounted on a slider which will automatically follow the magnetized ball 48 from distance play to the final action. The slider can also be a folding arm slider, a track, or a railing that is attached under the rear crossbar 15 to offering better option to capture better video images. The panoramic camera should have a pivoting base to rotate. This offer the ability to capture images by following the magnetized ball 48 from on point to the final scoring path. From long distance ahead and any angles before entering the goal line area for potential scoring without missing any traveling segment of the magnetized ball 48. In one embodiment, a radar camera is utilized to track the movement of the magnetized ball 48 until the magnetized ball 48 is scored or goes out of bounds. Rear net frame 14 includes a panoramic camera slider attached upside down under the rear crossbar 15 with a pivoting panoramic camera slider to rotate and turn 180 degrees from left to right angles. In one embodiment, the rear net frame 14 includes an at least one vertical camera slider attached to the first rear post 16 and the second rear post 17 which moves a camera along a vertical track. For American football embodiment of the present invention, the hologram projection device 45 is attached to the upper end of the gooseneck section that support the crossbar and the U-Shaped posts structure for the goal-line. Note, in other for the American football (NFL) to accept to have a projector attached to the NFL goalpost, it had to be behind the goal line area, that is why the gooseneck design is utilized. In another embodiment, the hologram projection device 45 is attached to the front crossbar 3. In one embodiment the hologram projection device 45 is mounted to the front crossbar 3 and the rear crossbar 15.

For soccer, the hologram projection device 45 is attachment in between the front crossbar 3 and the rear crossbar 15. For rugby, the hologram projection device 45 is attachment behind the goal line. For handball, the hologram projection device 45 is attached to the front crossbar 3 and the rear net frame 14. For hockey, the hologram projection device 45 is attached to the goal frame 2. For basketball, the hologram projection device 45 is attached behind the backboard. For football, the hologram projection device 45 may be used to announce with 3D projection each team and player before a game; projecting 3D team logo, projecting 3D "touchdown" during each scoring, American football helmets in 3D projection, NFL 3d ball, NFL jersey 3D projection, announcing the official team or championship sponsors, advertising logo and name, country flags, virtual advertising. Same hologram projection technology can be applied to basketball hoops and other racing sports. Also for racing sports with a finish line like car racing and horse racing, ski racing, sailing racing, tracking filed, bicycle tours etc. (water and non-water sports).

Although the invention has been explained in relation to its preferred embodiment, it is to be understood that many other possible modifications and variations can be made without departing from the spirit and scope of the invention as hereinafter claimed.

What is claimed is:

1. A multimedia crossbar system for goal posts comprising:

a goal net;

a goal frame;

a rear net frame;

a transparent display screen;

a projection device;

the goal frame comprising a front crossbar, a first post and a second post;

the rear net frame comprising a rear crossbar, a first rear post and a second rear post;

the first post being terminally connected to the front crossbar;

the second post being positioned opposite to the first post, across the front crossbar;

the second post being terminally connected to the front crossbar;

the first rear post being terminally connected to the rear crossbar;

the second rear post being positioned opposite to the first rear post, across the rear crossbar;

the second rear post being terminally connected to the rear crossbar;

the rear crossbar being positioned offset to the front crossbar;

the rear net frame being mounted offset to the goal frame;

the goal net being tethered in between the goal frame and the rear net frame;

the transparent display screen being positioned in between the first rear post and the second rear post;

the transparent display screen being perimetrically connected to the rear net frame;

the projection device being centrally mounted within the front crossbar;

the projection device being oriented towards the transparent display screen;

a plurality of hooks;

a second cable;

the plurality of hooks being distributed along the rear net frame;

each of the plurality of hooks being connected to the rear net frame;

the second cable being tensionably engaged to the plurality of hooks; and the second cable being tethered to the goal net, opposite the goal frame.

2. The multimedia crossbar system for goal posts as claimed in claim 1 comprising:

a multimedia bar system;

the multimedia bar system comprising a support bar, a plurality of lights and a plurality of speakers;

the support bar being positioned parallel and adjacent to the rear crossbar;

the support bar being connected along the rear crossbar;

the plurality of lights being distributed along the support bar;

each of the plurality of lights being connected to the support bar;

the plurality of speakers being distributed along the support bar;

each of the plurality of speakers being connected to the support bar; and each of the plurality of speakers and each of the plurality of lights being oriented towards the front crossbar.

3. The multimedia crossbar system for goal posts as claimed in claim 2 comprising:

the multimedia bar system comprising a plurality of sponsor display panels;

the plurality of sponsor display panels being distributed along the support bar; and each of the plurality of sponsor display panels being connected to the support bar.

4. The multimedia crossbar system for goal posts as claimed in claim 2 comprising:

the multimedia bar system comprising a remote control; and the remote control being communicably coupled to the plurality of lights and the plurality of speakers.

5. The multimedia crossbar system for goal posts as claimed in claim 2, wherein support bar is a sponsor display bar panel.

6. The multimedia crossbar system for goal posts as claimed in claim 1 comprising:

the first post being connected to the front crossbar by a first right square corner; and the second post being connected to the front crossbar by a second right square corner.

7. The multimedia crossbar system for goal posts as claimed in claim 1 comprising:

the first post being connected to the front crossbar by a first rounded corner; and the second post being connected to the front crossbar by a second rounded corner.

8. The multimedia crossbar system for goal posts as claimed in claim 1 comprising:

a first anchor bar;

a second anchor bar;

the first anchor bar and the second anchor bar being positioned offset and parallel to each other;

the first rear post being perpendicularly connected to the rear crossbar;

the second post being positioned parallel to the first post, across the front crossbar;

the second post being perpendicularly connected to the front crossbar;

the first rear post being perpendicularly connected to the rear crossbar;

the second rear post being positioned parallel to the first rear post, across the rear crossbar;

the second rear post being perpendicularly connected to the rear crossbar;

the rear crossbar being positioned parallel and offset to the front crossbar;

the first anchor bar being terminally connected in between the first rear post and the first post, opposite to the rear crossbar and the front crossbar;

the second anchor bar being terminally connected in between the second rear post and the second post, opposite to the rear crossbar and the front crossbar;

the first post being a first shock-absorbing post; and the second post being a second shock-absorbing post.

9. The multimedia crossbar system for goal posts as claimed in claim 8 comprising:

the first rear post being oriented at a first obtuse angle with the first anchor bar; and the second rear post being oriented at a second obtuse angle with the second anchor bar.

10. The multimedia crossbar system for goal posts as claimed in claim 8 comprising:

a first foundation base;

a second foundation base;

a third foundation base;

a fourth foundation base;

the first foundation base being terminally connected to the first post, opposite to the front crossbar;

the second foundation base being terminally connected to the second post, opposite to the front crossbar;

the third foundation base being terminally connected to the first rear post, opposite to the rear crossbar;

the fourth foundation base being terminally connected to the second rear post, opposite to the rear crossbar;

the first foundation base being terminally connected to the first anchor bar, adjacent to the first post;

the second foundation base being terminally connected to the second anchor bar, adjacent to the second post;

the third foundation base being terminally connected to the first anchor bar, adjacent to the first rear post;

the fourth foundation base being terminally connected to the second anchor bar, adjacent to the second rear post;

the first foundation base terminally enclosing the first anchor bar and the first post;

the second foundation base terminally enclosing the second anchor bar and the second post;

the third foundation base terminally enclosing the first anchor bar and the first rear post; and the fourth foundation base terminally enclosing the second anchor bar and the second rear post.

11. The multimedia crossbar system for goal posts as claimed in claim 1 comprising:

the first post being connected to the front crossbar by a first corner;

the second post being connected to the front crossbar by a second corner;

the first corner and the second corner each comprising an upper tubular portion;

the first corner being a first rounded corner or a first right square corner;

the second corner being a second rounded corner or a second right square corner;

the first post and the second post each comprising a lower tubular portion, an intermediate tubular portion, a first bushing, a second bushing and a central shaft;

the upper tubular portion, the intermediate tubular portion and the lower tubular portion being positioned concentric with each other;

the upper tubular portion and the lower tubular portion being positioned opposite to each other along the intermediate tubular portion;

the central shaft being concentrically positioned within the upper tubular portion, the intermediate tubular portion and the lower tubular portion;

a first end of the central shaft being connected to the upper tubular portion;

a second end of the central shaft being connected to the lower tubular portion;

the first bushing being positioned within the upper tubular portion and the intermediate tubular portion;

the first bushing being mounted to the central shaft, adjacent to the first end of the central shaft;

the second bushing being positioned within the lower tubular portion and the intermediate tubular portion; and the second bushing being mounted to the central shaft, adjacent to the second end of the central shaft.

12. The multimedia crossbar system for goal posts as claimed in claim 1 comprising:

a track;

a first cable;

the track being mechanically integrated along the first post, the front crossbar and the second post;

the track being oriented towards the rear net frame;

the first cable being perimetrically connected to the goal net, opposite the rear net frame; and the first cable being slidably engaged along the track.

13. The multimedia crossbar system for goal posts as claimed in claim 1 comprising:

a plurality of cable pulleys;

a second cable;

the plurality of cable pulleys being distributed along the rear net frame;

each of the plurality of cable pulleys being connected to the rear net frame;

the second cable being tensionably engaged to the plurality of cable pulleys; and the second cable being tethered to the goal net, opposite the goal frame.

14. The multimedia crossbar system for goal posts as claimed in claim 1 comprising:

a first camera;

a second camera;

a third camera;

a fourth camera;

the first camera being mechanically integrated in between the first post and the front crossbar;

the first camera being oriented towards the second post;

the second camera being mechanically integrated in between the second post and the front crossbar;

the second camera being oriented towards the first post;

the third camera being mechanically integrated in between the first rear post and the rear crossbar;

the third camera being oriented towards the goal frame;

the fourth camera being mechanically integrated in between the second rear post and the rear crossbar; and the fourth camera being oriented towards the goal frame.

15. The multimedia crossbar system for goal posts as claimed in claim 14 comprising:

the first camera, the second camera, the third camera and the fourth camera each being a weather-resistant camera.

16. The multimedia crossbar system for goal posts as claimed in claim 1 comprising:

the first rear post being terminally and perpendicularly connected to the rear crossbar;

the second rear post being positioned parallel and opposite to the first rear post, across the rear crossbar; and the second rear post being terminally and perpendicularly connected to the rear crossbar.

17. The multimedia crossbar system for goal posts as claimed in claim 1 comprising:

the first rear post being terminally and perpendicularly connected to the rear crossbar;

the second rear post being positioned parallel and opposite to the first rear post, across the rear crossbar; and the second rear post being terminally and perpendicularly connected to the rear crossbar.

18. The multimedia crossbar system for goal posts as claimed in claim 1 comprising:

the transparent display screen being a logo-imprinted net.

19. The multimedia crossbar system for goal posts as claimed in claim 1 comprising:

a three-dimension hologram projector; and the three-dimension hologram projector being centrally and externally mounted to the rear crossbar.

20. The multimedia crossbar system for goal posts as claimed in claim 1 comprising:

at least one electromagnetic shielding bar;

a magnetized ball;

the at least one electromagnetic shielding bar being positioned parallel to the front crossbar;

the at least one electromagnetic shielding bar being positioned in between the goal frame and the rear net frame;

the at least one electromagnetic shielding bar being mounted to the goal net, adjacent to the front crossbar;

the at least one electromagnetic shielding bar being positioned a first distance from the front crossbar; and the magnetized ball being communicably coupled to the at least one electromagnetic shielding bar.

21. The multimedia crossbar system for goal posts as claimed in claim 20, wherein the magnetized ball is composed of electromagnetic-field-shielding fabric.

22. The multimedia crossbar system for goal posts as claimed in claim 20, wherein the first distance is between 21.6 centimeters and 23 centimeters.

23. The multimedia crossbar system for goal posts as claimed in claim 1 comprising:

at least one master panoramic camera;

the at least one master panoramic camera being mounted to the rear net frame; and the at least one master panoramic camera being oriented towards the goal frame.

24. The multimedia crossbar system for goal posts as claimed in claim 1, wherein the rear net frame is a U-shaped rear net frame.

25. The multimedia crossbar system for goal posts as claimed in claim 1, wherein the rear net frame is a T-shaped rear net frame.

26. The multimedia crossbar system for goal posts as claimed in claim 1 comprising:

the goal net comprising a front section and a back section;

the front section and the back section being oppositely located to each other;

the front section being adjacently located to the goal frame;

the back section being adjacently located to the rear net frame;

the front section having a front width;

the back section having a back width; and the front width being larger than the back width such that the goal net tapers from the goal frame towards the rear net frame.

* * * * *